US005325976A

United States Patent [19]

Valyi et al.

[11] Patent Number: 5,325,976

[45] Date of Patent: Jul. 5, 1994

[54] CONTAINER CLOSURE ASSEMBLY

[76] Inventors: Emery I. Valyi, 19 Moseman Ave., Katonah, N.Y. 10536; Charles J. Brun, 2042 Erichman La., Xenia, Ohio 45385

[21] Appl. No.: 96,426

[22] Filed: Jul. 26, 1993

[51] Int. Cl.[5] ..... B65D 17/44

[52] U.S. Cl. ..... 215/232; 220/258

[58] Field of Search ..... 220/258, 278, 277; 215/232, 257, 228

[56] References Cited

U.S. PATENT DOCUMENTS 4,580,682 4/1986 Gorski et al. ..... 220/258

4,793,504 12/1988 Towns et al. .

4,813,578 3/1989 Gordon et al. ..... 220/528

5,082,136 1/1992 Schumann ..... 220/258

5,090,582 2/1992 Art et al. ..... 220/258

5,205,430 4/1993 Valyi ..... 220/258

*Primary Examiner*—Joseph Man-Fu Moy

*Attorney, Agent, or Firm*—Bachman & LaPointe

[57] ABSTRACT

A container closure assembly including a plastic container, a barrier layer and a closure member. The barrier layer and closure member completely cover the access opening to the container and the barrier layer includes a weakened portion thereof which is broken open on removing the closure member.

14 Claims, 3 Drawing Sheets

CONTAINER CLOSURE ASSEMBLY

BACKGROUND OF THE INVENTION

The present invention deals with a container closure assembly including a tamper proof closure and a barrier layer.

It is highly desirable to provide a container with a tamper-evident closure capable of being easily opened and reclosed without the use of a tool and also incorporating a gas permeation barrier, particularly when it is necessary to maintain the integrity of the contents of the container, as for example carbonated beverages. Thus, the closure should at least in part include a gas permeation layer in order to maintain the integrity of the container contents prior to opening. In addition, the closure should have the ability of showing whether or not it has been damaged or tampered with and it should also be sufficiently reclosable to avoid contamination of the contents after the opening of the container.

Heretofore, it has been difficult to accomplish the foregoing with plastic closures which are particularly suitable for plastic containers. It is clearly advantageous to utilize a closure as aforesaid made of plastic for plastic containers, preferably of the same plastic as the container, for convenience in recycling.

It is also desirable to provide a container closure assembly as aforesaid which is easy to prepare commercially and which is convenient and easy to use by the consumer.

Accordingly, it is a principal objective of the present invention to a provide a container closure assembly including a barrier layer, wherein the closure is resistant to gas permeation, is tamper-evident and is capable of being easily opened and reclosed.

It is a still further object of the present invention to provide a closure assembly as aforesaid which is easy to prepare, inexpensive and easy to use in practice.

Further objects and advantages of the present invention will appear hereinbelow.

SUMMARY OF THE INVENTION

In accordance with the present invention, the foregoing objects and advantages are readily obtained.

A container closure assembly is provided in accordance with the present invention including: a plastic container having a container neck and a rim portion defining an access opening for the container; a barrier layer having a rim and a central portion completely covering the access opening and with the barrier layer rim portion adhered to said container rim portion, including a weakened portion of said barrier layer in said barrier layer central portion; a removable closure member adapted to fit over said container neck, covering said container rim and barrier layer and engaging said container neck portion, said closure member intimately contacting said barrier layer when said closure member is removed by twisting; whereby removal of the closure member by twisting breaks the barrier layer at the weakened portion and opens the container. Preferably, the weakened portion is adjacent the barrier layer rim portion and the barrier layer and closure are preferably made of plastic.

In a preferred embodiment, the closure and the barrier layer include stepped portions adjacent one another over the access opening, with the stepped portions extending either outwardly away from the access opening or inwardly towards the access opening. Preferably also the barrier layer stepped portion includes corner portions, as for example, the barrier layer stepped portion defining a hexagonal configuration. Thus, on twisting the closure member to remove same, the closure member places the stepped portion of the barrier layer under torsion breaking the barrier layer at the weakened portion.

The closure member preferably defines a snap ring which engages the container neck. Also, the barrier layer is preferably an annular member including a rim portion which is bonded to the container rim. The weakened portion may be a notch in the barrier layer central portion. In a preferred embodiment, the barrier layer is an injection molded plastic part, as a disk, wherein the rim portion of the barrier layer comprises a first injection molded portion and including a central portion comprising a second injection molded portion, said barrier layer including an interface between the first and second injection molded portions which defines said weakened portion.

Thus, the container closure assembly of the present invention includes a barrier layer which protects the integrity of the contents of the container. Moreover, the assembly is tamper evident since one can readily see if the weakened portion of the barrier layer has been broken, as for example with a transparent closure member. Further, the closure assembly is easy to use and may readily be reapplied to the container, albeit without the integrity of the barrier layer, after partial use of the contents.

Further features and advantages of the present invention will appear hereinbelow.

BRIEF DESCRIPTION OF THE DRAWINGS

The present invention will be more readily understandable from a consideration of the following illustrative and partly schematic drawings wherein.

DETAILED DESCRIPTION

Figure 1:
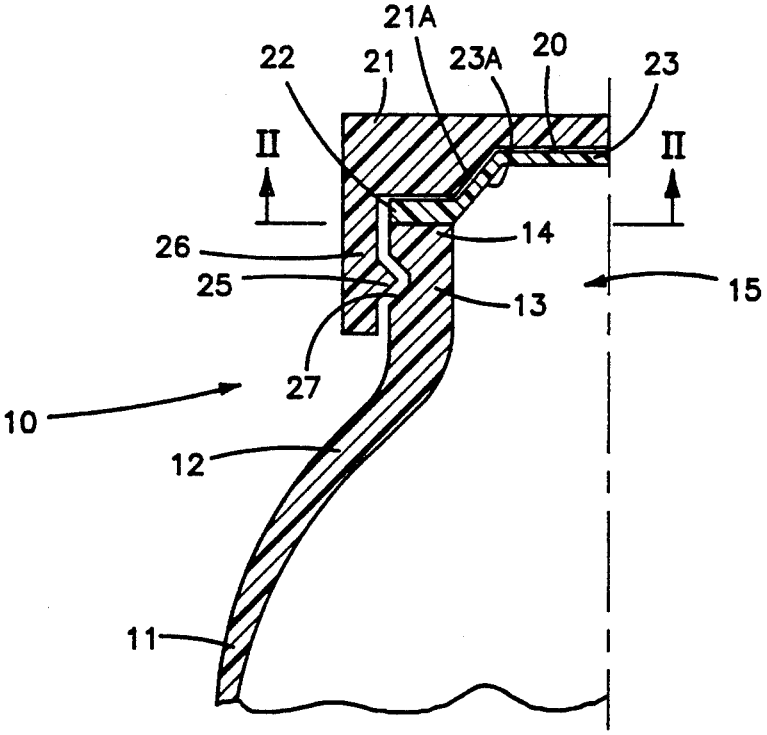
FIG. 1 is a partial sectional side view of a container closure assembly of the present invention.

FIG. 1 shows a partial sectional side view of container 10 having a container side wall 11 extending upwardly from a container bottom (not shown), container shoulder 12 extending upwardly from the container side wall, container neck 13 extending upwardly from the shoulder portion, and terminating in a container rim portion 14 defining an access opening 15 for container 10. The container 10 is preferably made of a plastic material, as polyethylene terephthalate (PET).

the closure assembly includes a barrier layer 20 and a closure member 21. The barrier layer may be made of the same plastic as the container; however it is preferably made more resistant to gas permeation than the container. Thus, if the container is made of the types of PET normally used for beverage bottles, the barrier layer may be made of PET which is more than 30% crystalline, or EVOH, both of which are compatible with the first mentioned PET for recycling. Similarly, the closure member may be made of PET or any rigid plastic and may if desired be made transparent so that the barrier layer can be seen. The barrier layer is generally thinner than the closure member and may be made by thermoforming or injection molding.

Barrier layer 20 has a rim portion 22 and a central portion 23 and completely covers access opening 15. Rim portion 22 of barrier layer 20 is adhered to container rim 14 to provide a gas impervious closure attachment for the unopened container. Thus, container 10 and barrier layer 20 may be made of plastic materials which have relatively good gas permeation resistance and which provide good barriers for the unopened container.

Removable closure member 21 is provided over container 10 and covering the container rim and a portion of the container neck as well as the barrier layer. Closure member 21 may have a snap ring 25 positioned on the inside of descending closure member leg 26 and engaging recess 27 in container neck 13 so that the closure member can be snapped in place and simply removed by snapping the closure off or by twisting.

Figure 2:
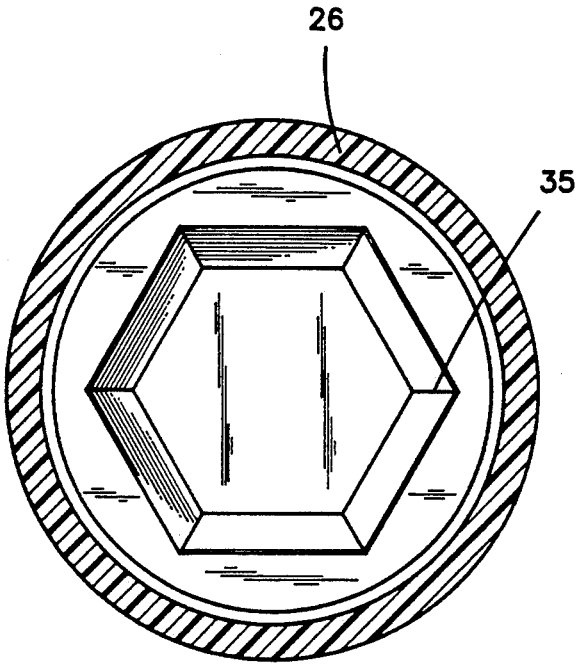
FIG. 2 is a sectional view through line II—II of FIG. 1.
Figure 3:
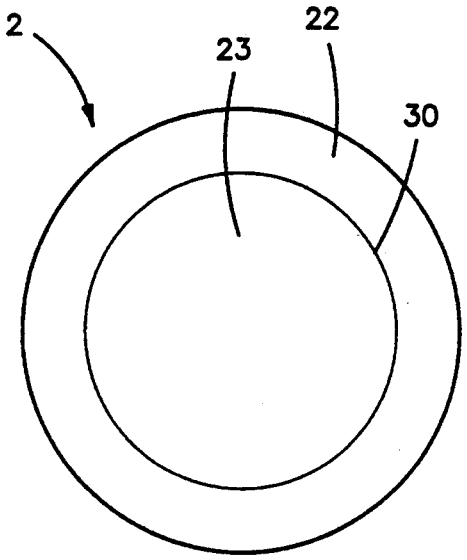
FIG. 3 is a top view of an injection molded barrier layer of the present invention.
Figure 4:
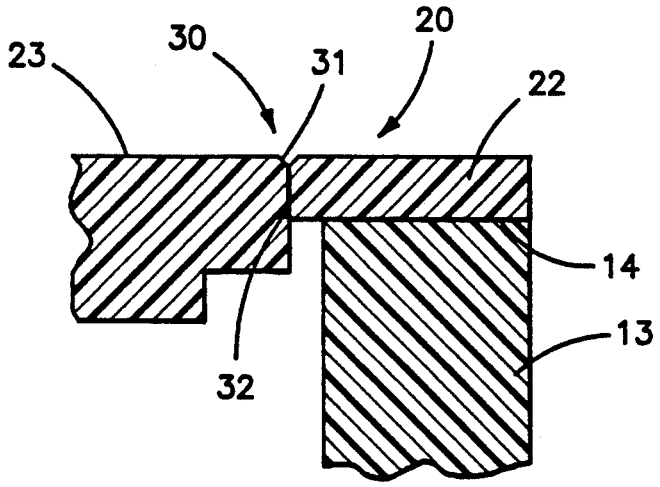
FIG. 4 is a partial enlarged sectional side view of a barrier layer-container interface.

As shown in FIG. 1, barrier layer central portion 23 includes a stepped portion 23A extending outwardly, away from access opening 15. Similarly, closure member 21 includes a corresponding stepped portion 21A also extending outwardly away from access opening 15. In addition, barrier layer 20 includes a weakened portion 30 in the barrier layer central portion 23 spaced inwardly of barrier layer rim portion 22. The weakened portion 30 is clearly shown in FIG. 4 and may comprise a notch 31 or a welded seam 32 or combinations of these such as is shown in FIG. 4. The welded seam is a preferred embodiment and is prepared by injection molding the barrier layer such as first injection molding rim portion 22 followed by second injection molding the central portion 23 to include an interface 30 between the first and second molded portions wherein the interface 30 defines the weakened portion. The first and second injection molding steps result in a welded seam between the rim portion of the barrier layer and the central portion of the barrier layer which represents a weakened location between the rim and central portions of the barrier layer. Thus, the weakened portion 30 may comprise the brittle interface between the two welded portions and/or a notched portion, both of which being shown in FIG. 4. FIG. 3 represents a top view of an injection molded barrier layer of the present invention wherein the barrier layer rim portion 22 was injection molded in a first step and the barrier layer central portion 23 was injection molded in a second step to form brittle interface or weakened portion 30 therebetween. Naturally, the central portion 23 may be injection molded in the first step and the rim portion injection molded in the second step, if desired. Barrier layer 20 is a generally annular or circular component conforming to the shape of a bottle or container rim portion 14 in order to allow a complete heat seal or welding between the barrier layer rim portion 22 and the container rim 14. As shown in FIG. 2, stepped portion 23A includes corner portions 35 and may be polygonal in cross section, such as the hexagonal configuration in FIG. 2 or the square configuration in FIG. 6. The stepped portion 23A of barrier layer 20 forms a dome-like configuration in FIG. 1. The corresponding stepped portions of the barrier layer and closure member are adjacent one another.

Thus, in accordance with the present invention, removal of the closure member by twisting puts pressure on the corresponding stepped portion of the barrier layer and breaks the seal at the weakened portion, opening the container. It is highly advantageous that the barrier layer remains in place until the closure member is twisted breaking the barrier layer at the weakened portion. Moreover, one can readily determine if the container has been previously opened by determining the integrity of the barrier layer. Thus, for example, one can determine visually through the container or through a transparent closure member if the barrier layer has been broken. Further, removing the closure member breaks the barrier layer audibly so that one can readily hear if the barrier layer is properly broken for the first time by twisting the closure member and removing same as by snapping or twisting. In addition, the container can be reclosed by simply snapping on the closure member, albeit without the integrity of the barrier layer. Naturally, also, a screw closure can be used, if desired.

Figure 5:
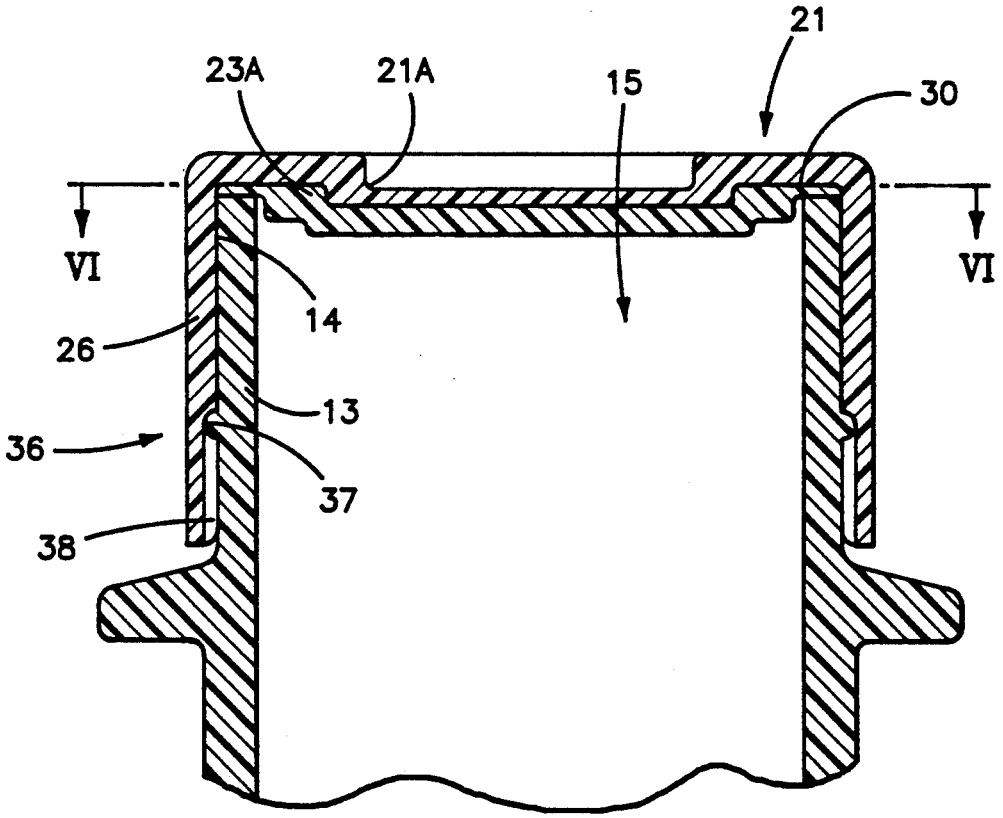
FIG. 5 is a partial sectional side view of an alternate embodiment of a container closure assembly of the present invention.
Figure 6:
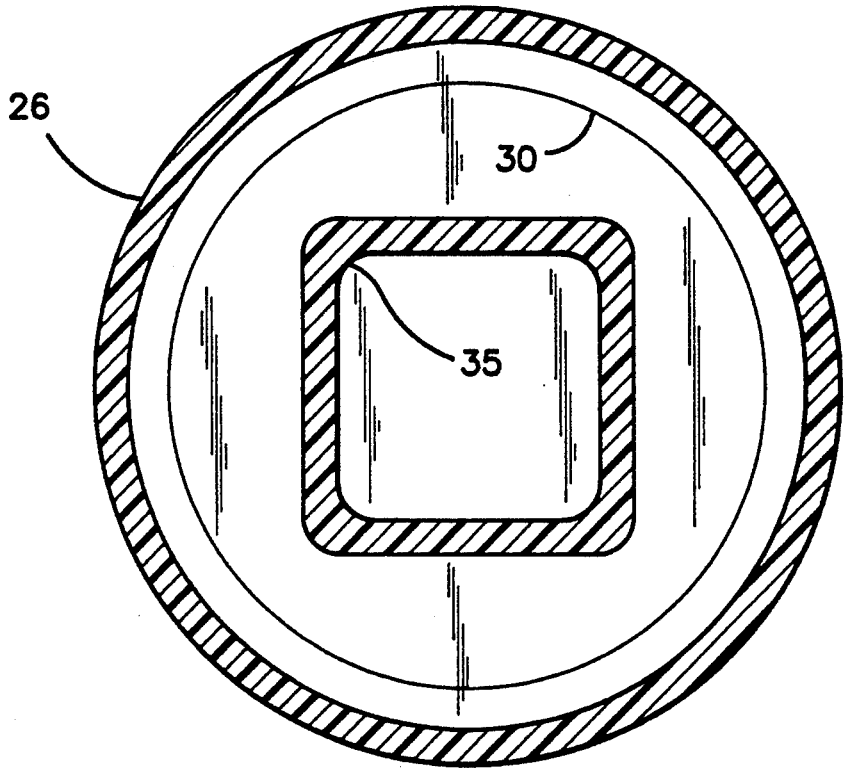
FIG. 6 is a sectional view through line VI—VI of FIG. 5.

FIGS. 5 and 6 represent an alternative embodiment of the present invention wherein the corresponding stepped portions 21A and 23A extend inwardly towards access opening 15. Also, as shown in FIGS. 5 and 6, snap ring 36 is defined by projection 37 on container neck 13 engaging groove 38 on closure member 21 descending leg 26. In the embodiment of FIGS. 5 and 6, weakened portion 30 is defined by a brittle welded zone between a first and second injection molded part.

Thus, in accordance with the present invention, a container closure assembly is provided which provides a firm barrier layer which is readily opened by simply twisting the closure member. At the same time, the closure assembly provides a tamper evident seal. Further, the closure assembly of the present invention is simple to prepare and use by the consumer.

It is to be understood that the invention is not limited to the illustrations described and shown herein, which are deemed to be merely illustrative of the best modes of carrying out the invention, and which are susceptible of modification of form, size, arrangement of parts and details of operation. The invention rather is intended to encompass all such modifications which are within its spirit and scope as defined by the claims.

What is claimed is:

1. A container closure assembly which comprises: a plastic container having a container neck and a rim portion defining an access opening for the container; a barrier layer having a rim and a central portion completely covering the access opening and with the barrier layer rim portion adhered to said container rim portion, said barrier layer including a weakened portion in said barrier layer central portion; a removable closure member adapted to fit over said container neck, covering said container rim and barrier layer and engaging said container neck portion, said closure member intimately contacting said barrier layer when said closure member is removed by twisting; wherein the closure member and barrier layer include stepped portions adjacent one another over the axis opening, said barrier layer stepped portions including corner portions thereof; whereby twisting the closure member places the barrier layer stepped portions under torsion breaking the barrier layer at the weakened portion and opening the container.

2. An assembly according to claim 1 wherein said weakened portion is adjacent said barrier layer rim portion.

3. An assembly according to claim 1 wherein said barrier layer and closure member are plastic.

4. An assembly according to claim 1 wherein the closure member and barrier layer include stepped portions adjacent one another over the access opening.

5. An assembly according to claim 4 wherein the stepped portions extend outwardly, away from the access opening.

6. An assembly according to claim 4 wherein the stepped portions extend inwardly towards the access opening.

7. An assembly according to claim 1 wherein the closure member defines a snap ring which engages the container neck.

8. An assembly according to claim 1 wherein the weakened portion of the barrier layer includes a notch.

9. An assembly according to claim 3 wherein the barrier layer is injection molded.

10. An assembly according to claim 1 wherein the barrier layer is an annular member including a rim portion thereof which is bonded to the container rim.

11. A container closure according to claim 1 wherein the closure is removed by twisting.

12. A container closure assembly which comprises: a plastic container having a container neck and a rim portion defining an access opening for the container; a barrier layer having a rim and a central portion completely covering the access opening and with the barrier layer rim portion adhered to said container rim portion, said barrier layer including a weakened portion in said barrier layer central portion; a removable closure member adapted to fit over said container neck, covering said container rim and barrier layer and engaging said container neck portion, said closure member intimately contacting said barrier layer when said closure member is removed by twisting; wherein the closure member and barrier layer include stepped portions adjacent one another over the axis opening, said barrier layer stepped portions including corner portions thereof and defining a configuration selected from the group consisting of a hexagonal configuration and a square configuration; whereby removal of the closure member by twisting breaks the barrier layer at the weakened portion and opens the container.

13. A container closure assembly which comprises: a plastic container having a container neck and a rim portion defining an access opening for the container; a barrier layer having a rim and a central portion completely covering the access opening and with the barrier layer rim portion adhered to said container rim portion, said barrier layer including a weakened portion in said barrier layer central portion; a removable closure member adapted to fit over said container neck, covering said container rim and barrier layer and engaging said container neck portion, said closure member intimately contacting said barrier layer when said closure member is removed by twisting; wherein the barrier layer is injection molded plastic comprising a first injection molded portion and a second injection molded portion, and including a brittle interface between the two injection molded portions defining the weakened portion; whereby removal of the closure member by twisting breaks the barrier layer at the weakened portion and opens the container.

14. A container closure according to claim 13 wherein the central portion of the barrier layer is the second injection molded portion, and the rim portion of the barrier layer is the first injection molded portion.

* * * * *